United States Patent [19]

Chapman et al.

[11] Patent Number: 5,065,488

[45] Date of Patent: Nov. 19, 1991

[54] TANDEM AXLE TRAILER PIN EXTRACTER DEVICE

[76] Inventors: Richard L. Chapman, 411 Kelley, P.O. Box 124, Waverly, Kans. 66871; Lewis E. Barb, 1029 Janice, Emporia, Kans. 66801

[21] Appl. No.: 496,855

[22] Filed: Mar. 21, 1990

[51] Int. Cl.[5] ..... B25P 27/14

[52] U.S. Cl. ..... 29/278

[58] Field of Search ..... 29/267, 270, 278; 254/25, 131; 81/177 A

[56] References Cited

U.S. PATENT DOCUMENTS

| | | | |
|---|---|---|---|
| 408,158 | 7/1889 | Beall . | |
| 1,768,425 | 6/1930 | Smith . | |
| 2,906,013 | 9/1959 | Kass | 29/278 |
| 3,168,750 | 2/1965 | Gathker, Jr. | 29/278 |
| 3,644,951 | 2/1972 | Colburn | 7/1 G |
| 3,843,981 | 10/1974 | Verest | 7/1 G |
| 4,050,107 | 9/1977 | Parma | 7/1 G |
| 4,531,274 | 7/1985 | Sanders | 29/267 |
| 4,838,578 | 6/1989 | Baxter | 280/149 |

*Primary Examiner*—J. J. Hartman

*Attorney, Agent, or Firm*—Litman, McMahon & Brown

[57] ABSTRACT

A tandem axle trailer pin extracter device for extracting lodged tandem axle trailer locking pins when repositioning the trailer relative to tandem axles thereunder. The self-contained, portable device comprises a hook-like mechanism for engaging the release handle which dislodges the locking pins. A pair of spring-loaded handles is placed in a cocked position such that a constant bias is constantly applied to the release handle while an operator rocks the trailer and axles back and forth, allowing the device to automatically and unattendedly extract the pins. After slowly moving the trailer forward or backward to the desired location for repositioning the trailer body relative to the axles, the bias is removed from the release handle and the device is disengaged therefrom. The trailer is then eased forwardly or rearwardly to the nearest set of bores whereat the spring-loaded pins automatically seek a locking position therein, rigidly securing the position of the trailer body relative to the tandem axles until such time as a subsequent load requires a re-adjustment of the relative position therebetween.

1 Claim, 2 Drawing Sheets

TANDEM AXLE TRAILER PIN EXTRACTER DEVICE

FIELD OF THE INVENTION

The present invention relates to a device for extracting lodged locking pins in the undercarriage of a tandem axle trailer when it is desired to shift the position of the trailer body relative to the tandem axles.

BACKGROUND OF THE INVENTION

Over-the-road trailers in common use today carry substantial loads weighing tens of thousands of pounds. To support these heavy loads, many of the trailers are mounted on multiple or tandem axles. Due to unlimited configurations in which various loads can be distributed within a trailer, unbalanced and improper loading can readily occur. In order to adjust and compensate for the different loading distributions, the undercarriage of such trailers is designed whereby the body portion of the trailer can be shifted relative to the position of the tandem axles thereunder. In other words, the spacing of the axles can be shifted forwardly or rearwardly to alter the distribution of weight among the front tandem axle, the rear tandem axle and the load bearing downwardly on a tongue or fifth wheel.

In order to perform the aforementioned repositioning of the trailer body relative to the tandem axles, a pair of rails in combination with sliding components are longitudinally disposed on the underside of the trailer body and above the tandem axles. A carriage containing the tandem axles is adapted to slide along such rails.

To lock the carriage at a particular location therealong, a series of uniformly spaced, transverse bores are cooperatively spaced along the two rails. Two pairs of pegs, one pair toward the front of the tandem axle carriage and the other pair toward the rear of the tandem axle carriage, provide locking means to retain the carriage at the desired relative location. The diameter of each of the pins is less than the diameter of the transverse bores. The pins are all interconnected by a linkage such that all four of the pins are simultaneously either seated in the respective bores in a locking position, or withdrawn from the bores in an extracted position. The pins are spring-loaded whereby the pins automatically attempt to seat themselves in such locked position.

A release handle is connected to the linkage which, when pulled, simultaneously extracts all four pins whereby the carriage can be repositioned and the pins allowed to seek appropriate bores to securely establish the new location of the trailer body relative to the tandem axles.

The difficulty with the aforedescribed arrangement lies with the fact that the magnitude of the masses involved with the trailer body and the tandem axles and the forces therebetween tends to cause the pins to be jammed in the locking position. Thus, when an operator attempts to extract the pins by pulling the release handle, the operator is incapable of applying sufficient force to extract the lodged pins.

Two approaches are commonly utilized to accomplish extraction of the lodged pins. In the first approach, the operator uses a tractor unit attached to the trailer to rock the trailer back and forth in an attempt to locate a position whereby the pins are no longer lodged and the release handle can be pulled. Sometimes several such rocking maneuvers must be conducted before the right combination is randomly discovered whereby the operator, working alone, can accomplish such repositioning. In most cases, however, such a procedure is time consuming and very frustrating to the operator.

In the other approach, the operator employs the services of an assistant. Under these circumstances, the operator rocks the trailer with the tractor unit while the assistant pulls on the release handle. Since the assistant can apply a steady pressure, the pins can be extracted more quickly than with the one-person approach. However, the use of the assistant introduces another concern of major importance. While pulling on the release handle, the assistant must unavoidably be situated near the release handle in order to apply the necessary force. Since the release handle is located in close proximity to the tandem axles, the assistant must be situated undesirably close to the wheels of the axles while the operator is causing the trailer to be rocked back and forth. Such an arrangement obviously subjects the assistant to uncertain danger and substantial risk.

Some prior art has been developed which allows the assistant to be somewhat more removed from the immediate proximity of the axles but, nevertheless, requires the services of an assistant, who may not always be available.

Other prior art has been developed which can provide a constant bias on the release lever while the operator is rocking the trailer, thus eliminating the dangerous exposure to the assistant. Unfortunately, such prior art requires adaptation of the undercarriage of the trailer to incorporate such apparatus therein. Thus, such apparatus becomes a permanent installation and each separate trailer requires its own separate and individual set of apparatus.

What is needed is a device which is portable so that it can realistically be used for repeated applications on numerous trailers, is adapted for a one-person application, and which is self-contained thereby avoiding the need to modify the undercarriage of existing trailers.

SUMMARY OF THE INVENTION

A tandem axle trailer pin extracter device is provided to extract lodged locking pins when it is desired to adjust the position of a trailer body relative to the tandem axles of the trailer in order to more properly distribute a load contained or to be contained in the trailer. The pin extracter device comprises an engagement mechanism containing a hook-like configuration which, in a first position, is adapted to engage a release handle, which extracts the locking pins by manipulating a linkage therebetween.

While a base end of the extracter device abuts a vertically oriented portion of the trailer undercarriage through which the release handle protrudes, a pair of handles springingly connected to the engagement mechanism are placed in a cocking position whereby a constant, unattended bias is applied to the release handle by the engagement mechanism. The magnitude of such bias is substantially greater than that collectively asserted by the springs associated with the pins and the linkage which causes the pins to seek their locking position.

While the bias is exerted against the release handle, an operator causes the trailer to be alternately nudged forwardly and rearwardly, typically by maneuvering a tractor unit hitched to the trailer, to randomly find a position of the trailer body relative to the tandem axles whereat the pins are not lodged in their locking position. When that occurs, the constant biasing of the release handle immediately pulls the release handle into a release position, extracting the pins from their locking position. Then, with the device still engaged with the release handle in order to maintain the pins in their extracted configuration, the trailer is moved forwardly or rearwardly until the trailer body is spaced relative to the tandem axles as desired. The handles of the device are then rotated and released whereby the tensioning bias previously placed on the release handle is removed and the device is disengaged from the release handle. The trailer body is then eased forwardly or rearwardly until the spring-loaded pins automatically seat themselves into a locking position in the nearest set of bores therefor.

The device reduces a two-person task with a certain amount of danger or a frustrating, time-consuming one-person task to a simple, straightforward, quickly performed, non-dangerous task performable by one person working alone.

Further, the device, which is portable, can be conveniently stored as desired. In addition, since the device is self-contained, it can be carried to and used on any other similarly equipped tandem axle trailer as desired without requiring modification of such trailer.

OBJECTS OF THE INVENTION

Therefore, the objects of the present invention are: to provide a device which provides a constant bias on a release handle for extracting lodged pins when repositioning a trailer body relative to tandem axles thereunder; to provide such a device which is self-contained; to provide such a device which does not require modification of existing trailers; to provide such a device which permits such extraction by one person acting alone; to provide such a device which eliminates the need for an assisting person to be situated near the axles when the release handle is being extracted; to provide such a device which is relatively lightweight and portable; to provide such a device which is not installed as an integral part of a trailer but can be discretionarily used as desired; and to generally provide such a device which is relatively easy to use, simple to maintain, reliable in performance, inexpensive to manufacture, and which generally performs the requirements of its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
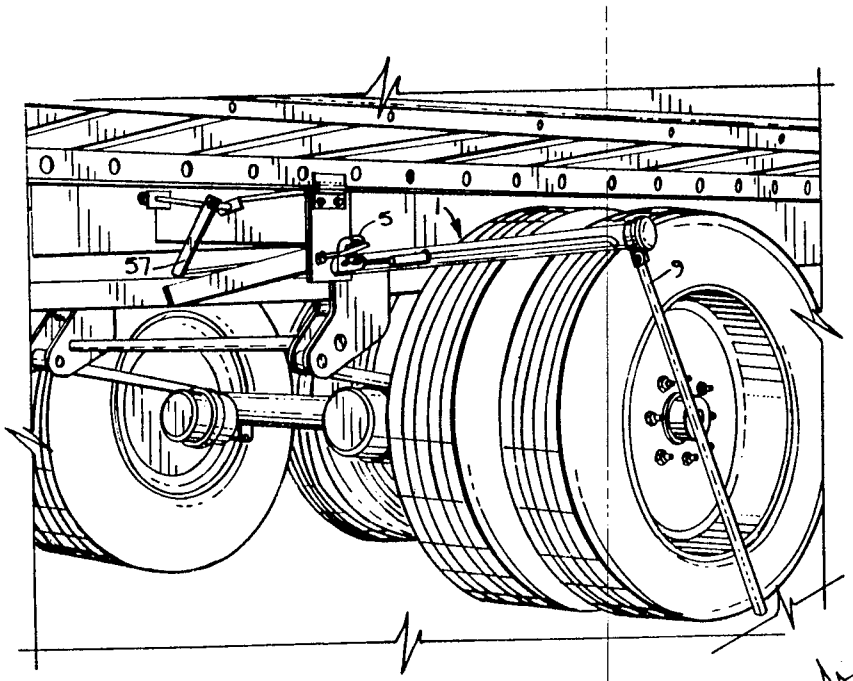
FIG. 1 is a perspective view of an attached but uncocked tandem axle trailer pin extracter device in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a tandem axle trailer pin extracter device in accordance with the present invention, shown in FIGS. 1 to 6. The tandem axle trailer pin extracter device 1 comprises a body 3, a hook-like or engagement mechanism 5, a cocking mechanism or biasing assembly 7, and a foot 9. Preferably, the body 3 comprises an elongate, cylindrically shaped shell 11.

A pair of matched, diametrically opposed slots 13 with substantially smooth, straight edges 15 penetrate a wall 17 of the body 3 and run longitudinally along the body 3 from near a base 19 of the body 3 to near a distal end 21 of the body 3. Each of the slots 13 has an extension or notch 23, which has a width (as measured longitudinally along the body 3) which is substantially equal to the width of each of the slots 13. Edges 25 of each of the notches 23 grade smoothly and arcuately into the edges 15 of the respective slots 13. Each of the notches 23 forms a shoulder 27 wherein an edge 29 thereof is substantially transverse to an axis of the body 3. (Alternatively, each of the notches 23 may be contoured such that a portion of each of the notches 23 may be spaced more closely to the base end 19 of the body 3 than the shoulder 27.)

A cap 31 is adapted to enclose the distal end 21 of the body 3 and is removably secured thereto. A clamp 33 is adapted to be removably secured to the body 3 near an outer extremity thereof and to provide a pivotal mounting mechanism 35 for the foot 9, such that the foot 9 can be spaced along the body 3 when not in use, as indicated in phantom in FIG. 3 and as referenced by the numeral 37. The foot 9 is elongate with a length of approximately three feet. (Alternatively, the foot 9 may be adapted whereby a portion thereof will telescope inwardly within another portion thereof for storage purposes and to telescope outwardly to a locking position to perform the purposes as herein described.

Figure 3:
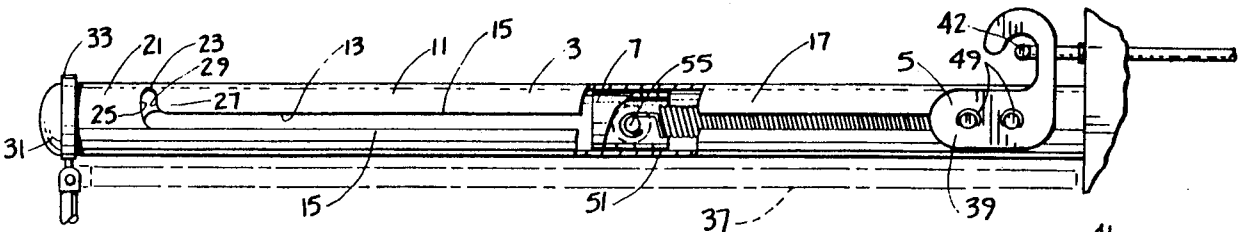
FIG. 3 is an enlarged and fragmentary side elevational view of the tandem axle trailer pin extracter device in the attached but uncocked position, with portions broken away to reveal details thereof.

The device 1 includes engagement means, such as the engagement mechanism 5 comprising a pair of sides 39, each of which has a shank 40 and which terminates in a relatively narrow finger 41 which is substantially semicircularly arcuate with a distal end thereof substantially pointing back at the respective shank 40, as shown in FIG. 3. The fingers 41 are adapted to be insertible under a release handle 42 of a tandem axle trailer 43 as hereinafter described. The fingers 41 are rigidly secured together and reinforced with a pair of spacers 44 which are adapted to space apart the sides 39 at a distance which is slightly greater than the outside diameter of the body 3.

A first or hook sleeve 45 is hollow and is cylindrically shaped with an outside diameter slightly smaller than the inside diameter of the body 3. The sleeve 45 is slidably secured within the body 3.

Two substantially similar alignment pins, an alignment pin 46 and a spring pin 47, pass through bores 48 in one of the hook sides 39, through one of the slots 13, through diametrically opposed bores in the hook sleeve 45, through the other slot 13, and through the other hook side 39. Grooves (not shown) and keeper rings 49 are adapted to removably secure the alignment pin 46 and the spring pin 47 in place relative to the slots 13, the hook sleeve 45, and the hook sides 39.

The device 1 comprises a cocking or biasing means, such as the biasing assembly 7 in conjunction with the notches 23. The biasing assembly 7 comprises a tension spring 50, a second or guide sleeve 51, and a handle assembly, such as a pair of handles 53 substantially coaxially aligned with each other. A biasing or handle pin 55 passes through one of the slots 13, through diametrically opposed bores in the guide sleeve 51, and through the other slot 13. One of each of the handles 53 is rigidly secured to each end of the handle pin 55. The spacing between the handles 53 is slightly greater than the outside diameter of the body 3. The biasing assembly 7 is adapted to be slidably displacible longitudinally within the body 3 wherein the handle pin 55 is movable within the slots 13 and rotatable into the notches 23.

The spring 50 has an outside diameter which is smaller than the inside diameter of the body 3. One end of the spring 50 is looped over or otherwise secured to the spring pin 47 interiorally to the hook sleeve 45 and the other end of the spring 50 is similarly secured to the handle pin 55 interiorally to the guide sleeve 51. The spring 50 has a spring constant which produces a force sufficient to overcome the spring-loading of the pins when they are not lodged.

In an actual application of the device 1 to a tandem axle trailer having a fore pair of pins and a corresponding rear pair of pins jammed or lodged in a locking position, the biasing assembly 7 is physically moved along the slots 13 to a first biasing position whereat the alignment pin 46 substantially abuts against an unbiased end 56 of each of the slots 13 (as opposed to a biased end 56*a* of the slots 13). The biasing assembly 7 is then in a first or unbiased position. Then, an operator typically grasps the body 3 with both hands and, while holding the body 3 at an inclined angle whereat the body distal end 21 is elevated above the body base end 19, slips the fingers 41 under, behind and partially over the release handle 42 of the tandem axle trailer 43, as illustrated in FIG. 3.

To support the body distal end 21, the distal end of the foot 9 is pivotally rotated downwardly such that it contacts a relatively solid surface to provide such support and supports the body 3 in a substantially horizontal orientation.

Figure 4:
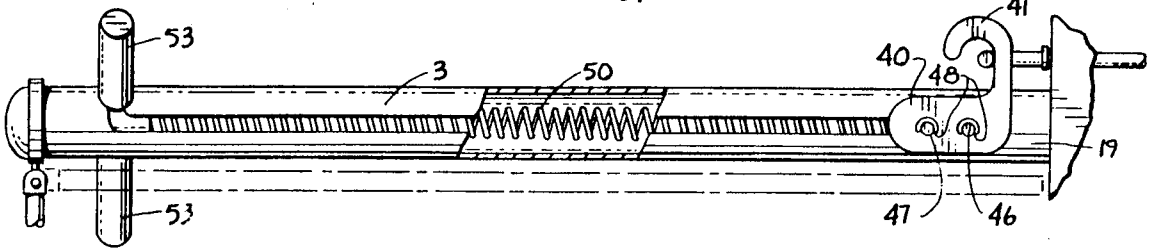
FIG. 4 is an enlarged and fragmentary side elevational view of the tandem axle trailer pin extracter device in a cocked position, with portions broken away to reveal details thereof.

The operator then grasps one of each of the handles 53 in each hand and pulls the handles 53 longitudinally outwardly such that the handle pin 55 travels along the slots 13 until the handle pin 55 reaches the notches 23 whereat the handle pin 55 is rotated therein. The handles 53 are then released such that the handle pin 55 bears against and is springingly restrained by the shoulder 27, placing the biasing assembly in a second or biasing position. The spring 50, which is stretched between the handle pin 55 and the spring pin 47, urges the fingers 41 longitudinally outwardly biasing the release handle 42 thereagainst. The device 1 is then in a cocked configuration as shown in FIG. 4, and a tandem axle trailer pin linkage 57 is in a locked position.

Figure 2:
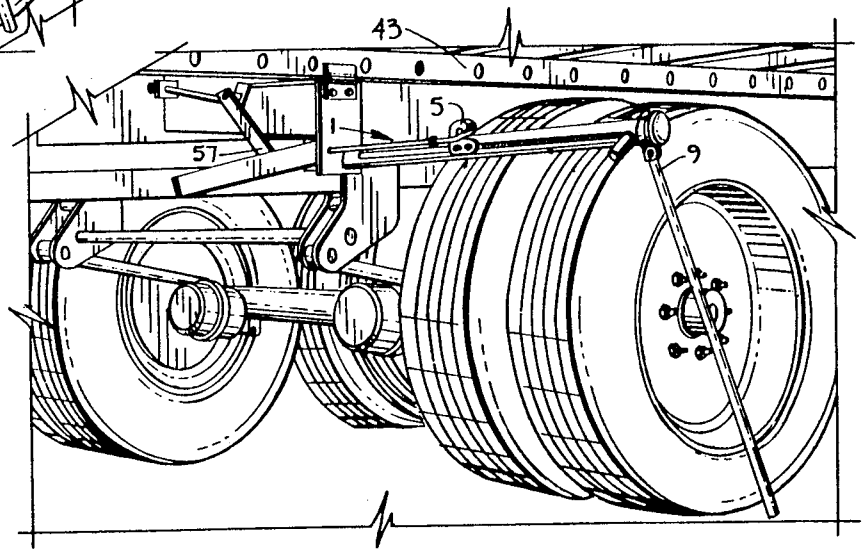
FIG. 2 is a perspective view, similar to FIG. 1, but showing the tandem axle trailer pin extracter device with a tandem axle trailer pin linkage in a release position.
Figure 5:
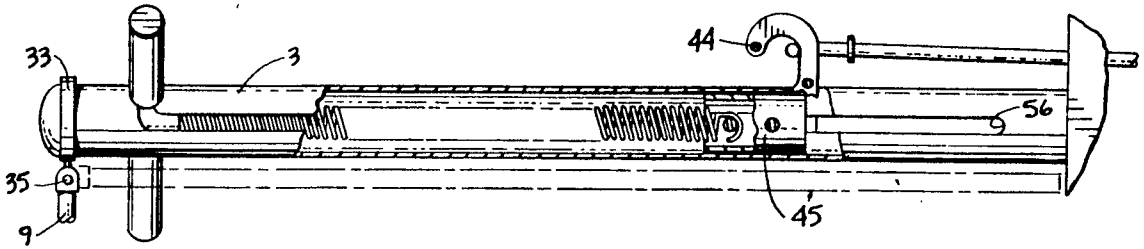
FIG. 5 is an enlarged and fragmentary side elevational view of the tandem axle trailer pin extracter device with a tandem axle trailer pin handle in a release position, with portions broken away to reveal details thereof.
Figure 6:
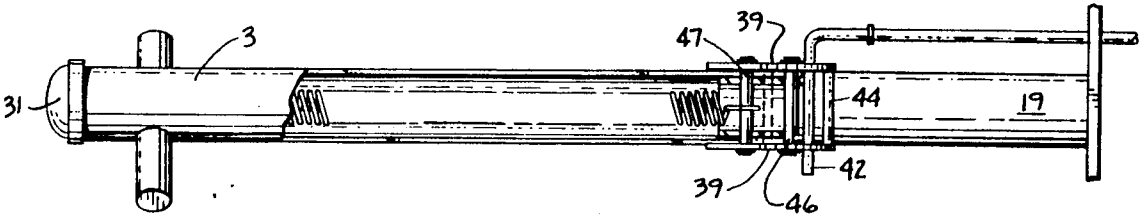
FIG. 6 is an enlarged top plan view of the tandem axle trailer pin extracter device similar to that of FIG. 5, with portions broken away to reveal details thereof, in accordance with the present invention.

The operator then leaves the cocked device 1 unattended while the tandem axle trailer 43 is alternately and repeatedly nudged back and forth, such as by a tractor unit hitched to the trailer 43. During such rocking of the tandem axle trailer 43, a particular position will be attained whereby none of the four pins is lodged and the biasing by the fingers 41 causes the release handle 42 to be pulled whereby the linkage 57 is changed from a locking configuration, as shown in FIG. 1, to a release configuration, as shown in FIG. 2. As a result, the locking pins, which are controlled by the linkage 57, are withdrawn or extracted from their locking position. The engagement mechanism 5 has then assumed a second, extracted or release configuration, as shown in FIG. 5.

While the engagement mechanism 5 is in the release position, the trailer body 43 is moved relative to the tandem axles to reposition the trailer 43 over the axles as desired. When so repositioned, the operator returns to the device 1, rotates the handle pin 55 into the slots 13 and permits the handle pin 55 to travel therealong to remove the bias previously applied against the fingers 41.

The operator then inclines the distal end 21 of the device 1 upwardly whereby the fingers 41 can be slipped backwardly and downwardly from the handle 42, releasing the device 1 therefrom. Since the linkage 57 and the pins are spring-loaded such that the pins tend to seek their locking position, it is a simple matter for the operator, again using the tractor unit, to ease the trailer forwardly or rearwardly as desired whereupon the pins automatically lock into respective bores upon alignment therewith.

Thus, a job which previously was very time consuming and frustrating for an operator working alone, or was dangerous for another person working in conjunction with the operator, has been reduced to a relatively quick, easy, one-person task. Further, since the device 1 is self-contained and portable, the device 1 can be used to service a multiplicity of tandem-axle trailers without modification thereof.

It is to be understood that while certain forms of the present invention have been illustrated and described herein, it is not to be limited to the specific forms or arrangement of parts described and shown.

What is claimed and desired to be secured by Letters Patent is as follows:

1. A portable, self-contained device for unattended extraction of lodged pins when repositioning a trailer body relative to tandem axles therebeneath, comprising;

(a) an elongate cylindrically-shaped body comprising a pair of diametrically opposed slots longitudinally disposed in sides thereof; each said slot having a non-biasing end near a base of aid body and a biasing end near the distal end of said body, said slots having a transverse, diametrically opposed extension at the biasing ends thereof;

(b) an engagement mechanism comprising a pair of hook-shaped sides; said hook-shaped sides rigidly displaced from each other at a distance which is slightly greater than the outside diameter of the body;

(c) a first sleeve and a second sleeve, each having an outside diameter which is slightly smaller than the inside diameter of said body; each said sleeve slidably secured within said body;

(d) a pair of alignment pins, each of which passes through said diametrically opposing slots, diametrically through said first sleeve, and through both hook-shaped sides, rigidly securing said hook-shaped sides to said first sleeve; said alignment pins slidably restrained to movement along said slots;

(e) a cocking mechanism comprising a pair of handles; said handles rigidly displaced from each other at a distance which is slightly greater than the outside diameter of the body; said handles substantially co-axially aligned with each other;

(f) a biasing pin which passes through said diametrically opposing slots, diametrically through said second sleeve, and rigidly secured to an end of each of said pair of handles, said biasing pin rigidly securing said handles to said second sleeve; said biasing pin slidably restrained to movement along said slots and said extensions thereof;

(g) a tension spring having an outside diameter which is smaller than the inside diameter of said body; said spring contained within said body; said spring having a first end secured to one of said alignment pins and a second end secured to said biasing pin; said spring having a spring constant sufficient to overcome a spring-loading of said pins when said pins are not lodged;

(h) said engagement mechanism having a first position whereat one of said alignment pins abuts the non-biasing ends of said slots and a second position, which is assumed by said engagement mechanism when secured to a release handle linked to extracted pins of the tandem axle trailer; and (i) said cocking mechanism having a first position whereat said engagement mechanism is substantially in its first position and a second position whereat said biasing pin has been rotated into said slot extensions and whereat said spring applies a force while said engagement mechanism moves from its said first position to its said second position, said force greater than that required to overcome a spring-loading of said pins when said pins are not lodged and to extract them from their locking position.

* * * * *